United States Patent [19]

Glass

[11] Patent Number: 4,624,210

[45] Date of Patent: Nov. 25, 1986

[54] BARRICADE

[76] Inventor: Geoffrey M. Glass, 21 Bridlewood Rd., Northbrook, Ill. 60062

[21] Appl. No.: 686,930

[22] Filed: Dec. 27, 1984

[51] Int. Cl.[4] ..... E01F 9/04

[52] U.S. Cl. ..... 116/63 P; 356/64; 404/6

[58] Field of Search ..... 116/63 P; 256/64, 65, 256/66; 404/6, 9, 10; 40/612, 606, 610

[56] References Cited

U.S. PATENT DOCUMENTS

| | | | |
|---|---|---|---|
| 1,995,656 | 3/1935 | Stout | 256/64 |
| 2,235,282 | 3/1941 | Carver | 116/63 P |
| 2,981,519 | 4/1961 | Barstow | 256/64 |
| 3,056,377 | 10/1962 | Nelson | 116/63 P |
| 3,253,570 | 5/1966 | Gunderson | 116/63 P |
| 3,627,273 | 12/1971 | Birner | 256/64 |
| 3,697,738 | 10/1972 | Decker et al. | 116/63 P |
| 3,802,667 | 4/1974 | Kanan | 256/64 |
| 3,880,406 | 4/1975 | Stehle et al. | 116/63 P |
| 3,917,232 | 11/1975 | Linder | 256/64 |
| 3,950,873 | 4/1976 | Stehle et al. | 116/63 P |
| 4,298,186 | 11/1983 | Glass | 256/64 |

*Primary Examiner*—Charles Frankfort
*Assistant Examiner*—Patrick R. Scanlon
*Attorney, Agent, or Firm*—Willian Brinks Olds Hofer Gilson & Lione Ltd.

[57] ABSTRACT

An improved barricade is composed of two identical, hollow, molded plastic panel units which are bolted together at top hinges. Novel detents lock the barricade in an open position for use. This mechanism allows for folding and storage by pushing the legs together with a substantial force. The panel units incorporate reinforcing ribs on the legs that taper off at their top and cooperate with opposing leg members and a specially shaped hinge section to allow for flat, compact storage. Horizontal panels are flush to the surface of the panel unit for optimum strength and space utilization. Bottom portions of the hollow panel units are filled with sand as a ballast to increase stability. A special mounting bracket is attached next to one of the hinges to support attachments such as flashers.

7 Claims, 14 Drawing Figures

FIG. 1
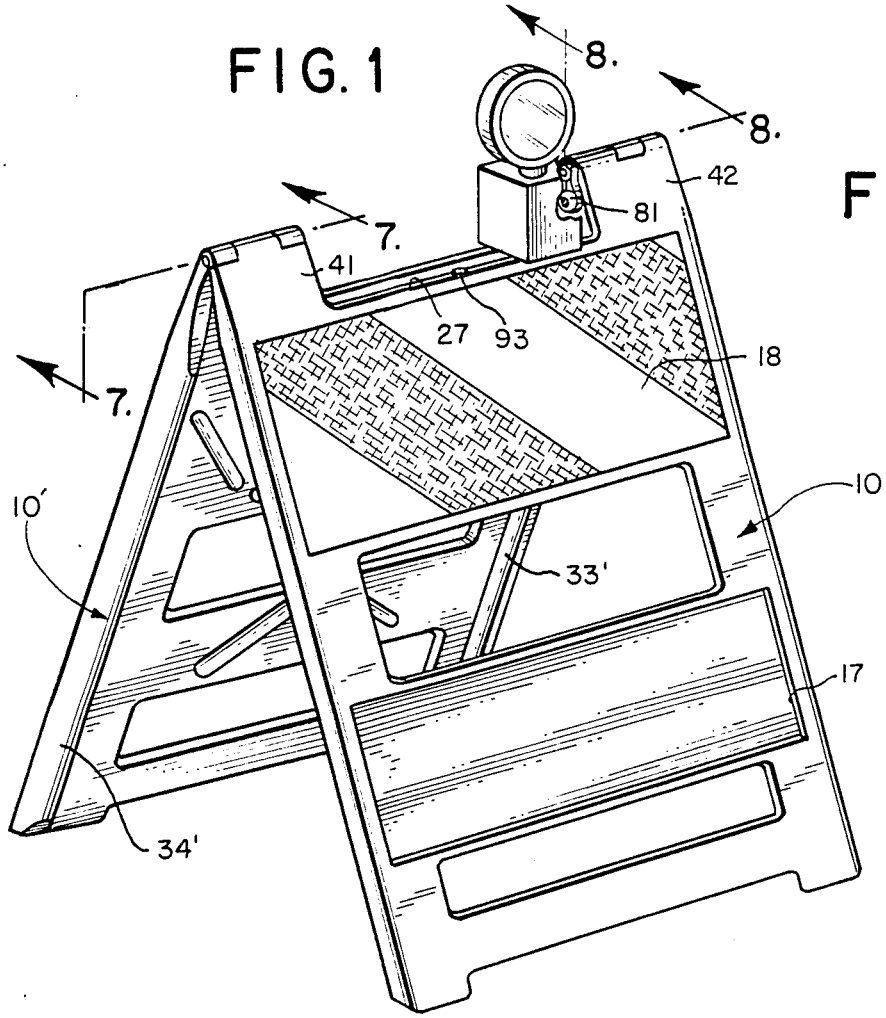
FIG. 6
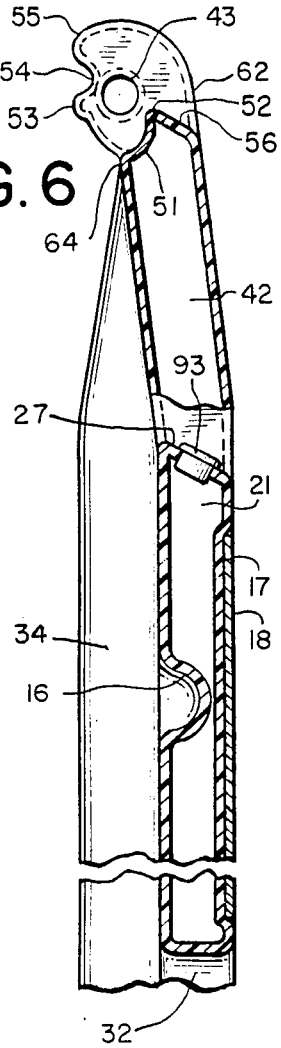
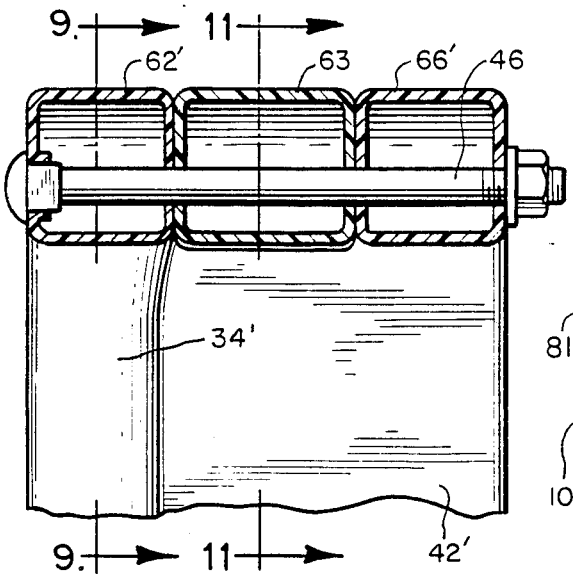
FIG. 7
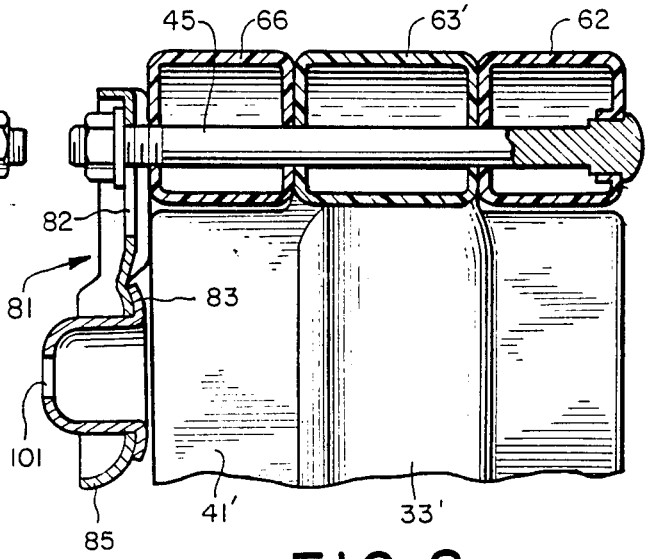
FIG. 8

BARRICADE

FIELD OF THE INVENTION

This invention relates to traffic barricades. It relates particularly to molded plastic traffic barricades.

BACKGROUND OF THE INVENTION

Traffic barricades are commonly used to warn vehicle traffic and pedestrians of danger, and block off restricted areas. Barricades made of molded plastic have been known for some time. Examples are found in the Stehle, et al. U.S. Pat. Nos. 3,880,406 and 3,950,873 and the Glass U.S. Pat. No. 4,298,186. Barricades illustrated in these patents include, among others, barricades made with two panel units hinged together so that they can be spread apart for use and collapsed for storage or transport. The individual panel units are one piece, integral, hollow plastic panels, formed by rotational or blow molding. The lower hollow sections may contain ballast.

These early plastic traffic barricades were a great improvement over conventional steel and wood barricades. They are rugged, yet cause less damage to vehicles if inadvertently struck. Through the use of ballast in the units, the center of gravity of the barricade is lower than either wood or metal barricades. The result is a barricade less susceptible to being blown over by wind. Other features typically incorporated in such barricades are bright colored reflective horizontal panels, flashing lights or signs, and a structural member near the bottom where a sand bag can be placed if additional ballast is required.

Traditional and heretofore known plastic barricades have a functional weakness in that if a gust of wind rocks the barricade backward, the forward legs automatically fold to the rear and the barricade tumbles. A similar problem is encountered when the barricade is set up on a slope. Heavy sand bagging is often required to alleviate these problems.

SUMMARY OF THE INVENTION

The present invention is directed to an improved barricade that can be locked in an open position for use and folded flat for storage.

In the preferred embodiment the barricade of this invention includes two hollow plastic panel units comprised of three horizontal panel members and two side leg members. The barricade is durable, versatile and weighted by ballast in the bottom for stability. A mounting bracket is provided to attach accessories such as a flashing light or sign.

An important advantage of this barricade is that it may be locked in an open position for stability, yet it retains the capability of automatically folding when a substantial force acts to close it. This detent feature allows the barricade to remain open even if a gust of wind rocks it back on one pair of legs. Coupled with a low center of gravity provided by the hollow design and the ballast, however, the detent feature also allows the barricade to fold and fall down flat if struck by a vehicle, thus reducing damage to the vehicle and the barricade.

These and other objects and advantages of the present invention will be best understood by reference to the following detailed drawings.

BRIEF DESCRIPTION OF THE DRAWINGS

FIG. 1 is a perspective view of the improved barricade.

FIG. 6 is an enlarged sectional side view taken on line 6—6 of FIG. 5.

FIG. 7 is an enlarged sectional view of the novel hinge taken on line 7—7 of FIG. 1.

FIG. 8 is another enlarged sectional view of the novel hinge and mounting bracket taken on line 8—8 of FIG. 1.

DESCRIPTION OF THE PREFERRED EMBODIMENT

Figure 4:
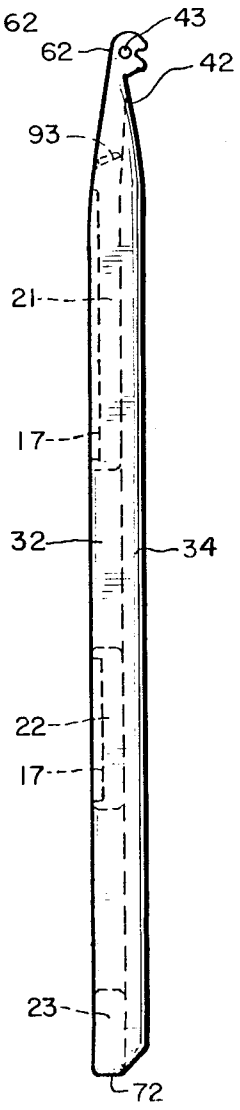
FIG. 4 is the other side view of the individual panel unit of FIG. 2.

Referring to the drawings, FIG. 1 illustrates a preferred embodiment of a plastic barricade assembly embodying features of the present invention. The assembly is comprised of a pair of identical, integral, hollow plastic panel units 10 and 10'. (Throughout the specification, all parts of panel unit 10' are numbered exactly as their counterparts in panel unit 10, with the added prime (') designation.)

Figure 2:
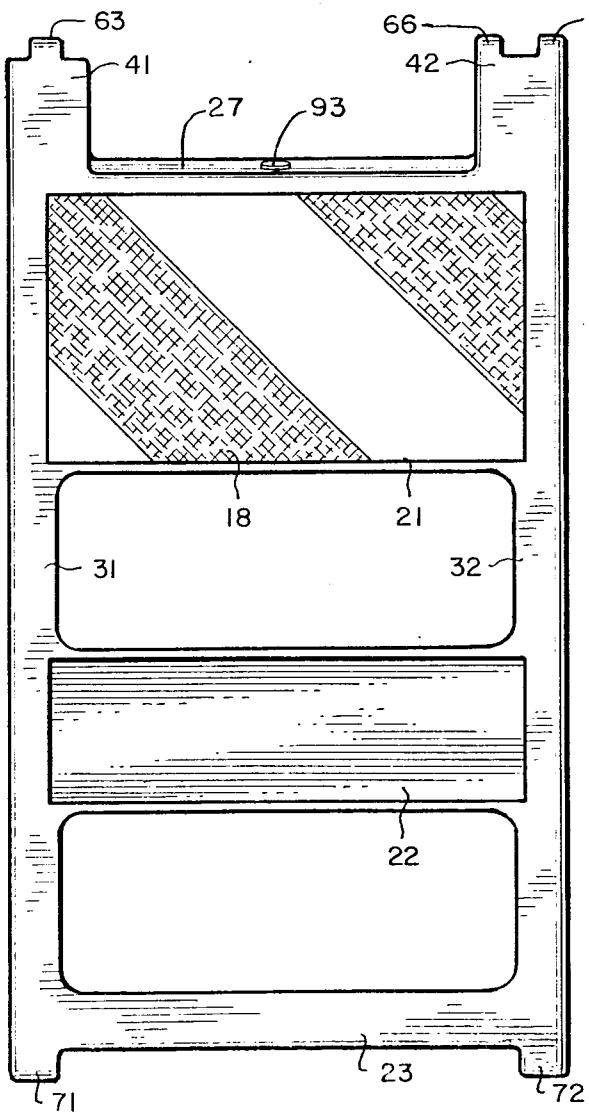
FIG. 2 is a front view of an individual panel unit of the barricade of FIG. 1.

FIG. 2 shows an individual panel unit. Each panel unit is constructed with three horizontal panel members 21, 22 and 23, two vertical leg members 31 and 32, extended foot portions 71 and 72, and hinge members 41 and 42. These segments are discussed as such, but are actually parts of the hollow, integral panel unit, molded as a unitary structure by conventional blow molding techniques. Panel members 21 and 22 are sometimes referred to as "stripe bars".

The top horizontal panel member 21 is approximately 13 inches high, 19 inches wide and 1 inch thick. The middle horizontal panel member 22 is approximately 9 inches high, 19 inches wide and 1 inch thick. Lower horizontal panel member 23 is approximately 3 inches high, 19 inches wide and 1 inch thick. The primary functions of member 23 is to allow sand bagging when necessary and to laterally reinforce the lower legs.

Vertical leg members 31 and 32 are approximately 39 inches in length and 2.5 inches wide where they are not contiguous with the horizontal panel members 21, 22 and 23, or hinge members 41 and 42. As displayed in FIG. 5, leg members 31 and 32 respectively include a reinforcing rib 33 and 34, which makes a bulge in the leg member cross section. The thickness of the leg members 31 and 32 is about 1 inch in the narrow area, and about 2 inches in the bulged area. The reinforcing ribs are about 1.25 inches wide. The reinforcing rib is important to provide sufficient rigidity to the plastic panel units to prevent the barricade from sagging when it is in an open position.

The foot members 71 and 72 extend approximately 1.5 inches below the lower horizontal panel member 23. Essentially they form a continuation of leg members 31 and 32. Their cross section, width and thickness at the top is the same as that of the contiguous leg members, but the reinforcing ribs 33 and 34 taper off at the bottom, leaving the bottom of the foot members 71 and 72 with a roughly rectangular cross section about 1 inch thick and 2.5 inches wide. The foot members 71 and 72 allow the barricade to be secured on uneven terrain.

Figure 12:
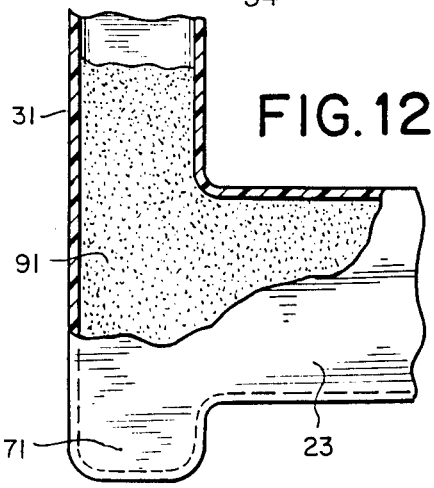
FIG. 12 is an enlarged sectional view of the bottom corner of the individual panel unit of FIG. 2.

The panel unit 10 is filled with approximately 5 pounds of ballast material 91 (FIG. 12). The ballast naturally fills the lower portions of panel unit 10, including foot members 71 and 72, the lower panel member 23, and the lower portions of leg members 31 and 32. The ballast material 91, which preferably is comprised of sand, is loaded into the panel unit 10 through a circular port, drilled in the top surface 27 of panel member 21 (FIG. 6) after the molding process. Alternatively, the port may be formed during the molding process, and may even be the blow molding blow hole. After the ballast is loaded, the port is permanently sealed by friction welding a circuit plug 93 into the port with conventional friction welding techniques. Scrap metal fillings, water, or other suitable material may also be used as ballast.

Figure 3:
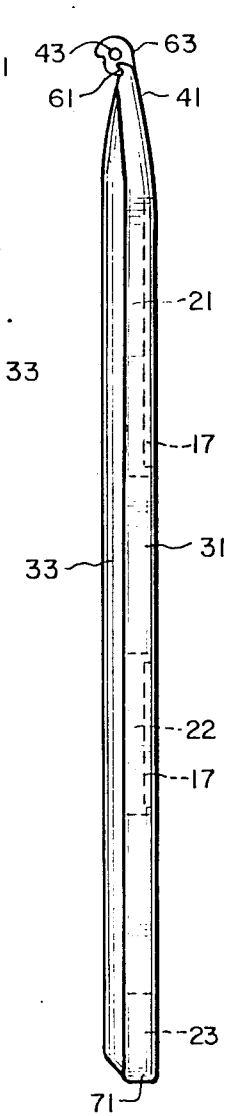
FIG. 3 is a side view of the individual panel unit of FIG. 2.
Figure 5:
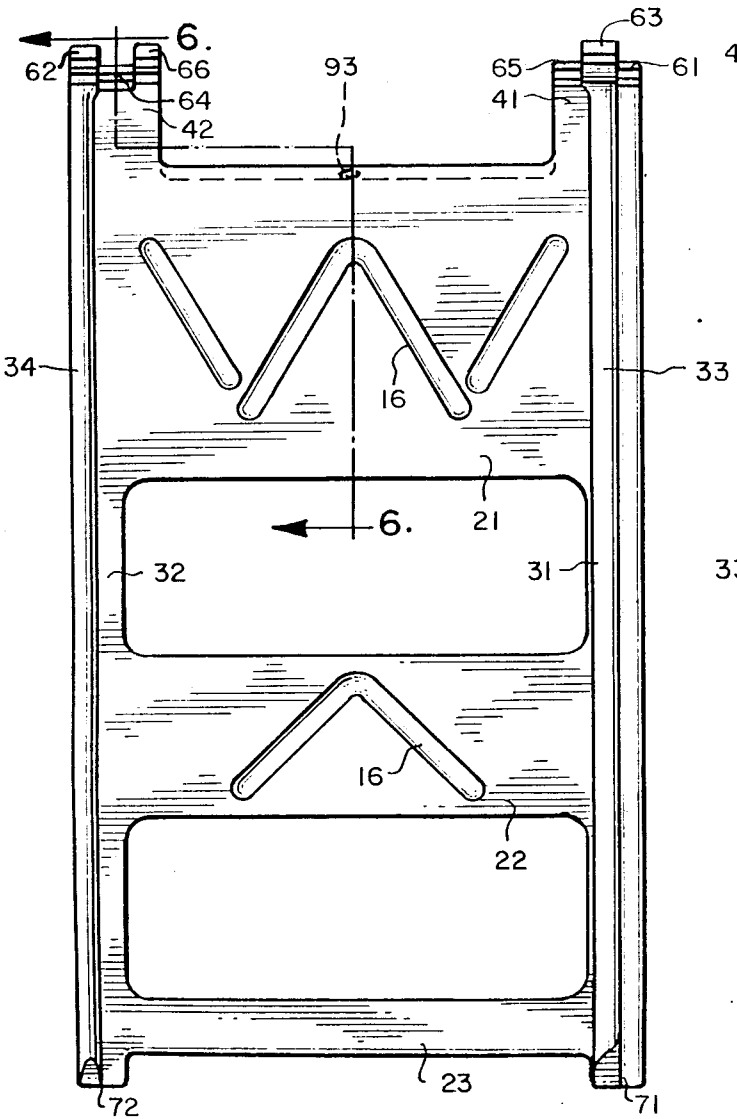
FIG. 5 is a rear view of the individual panel unit of FIG. 2.

As shown in FIGS. 3, 4 and 6, the front surfaces of horizontal panel members 21, 22 and 23 are flush with the front surface of the leg members 31 and 32, except for slight recesses 17 in panel members 21 and 22 and adjoining sections of leg members 31 and 32, which provide an indented surface for the bright colored reflective tape 18. The recesses 17 reduce damage to the tape by keeping the edges of the tape protected in the corners made by the recesses 17 and front surfaces of the panel members 21 and 22 and leg members 31 and 32. Horizontal panel members 21 and 22 also have indented reinforcing ribs 16 molded in their back surface (FIG. 5). These ribs are approximately 0.75 inches deep and 1 inch wide.

Figure 10:
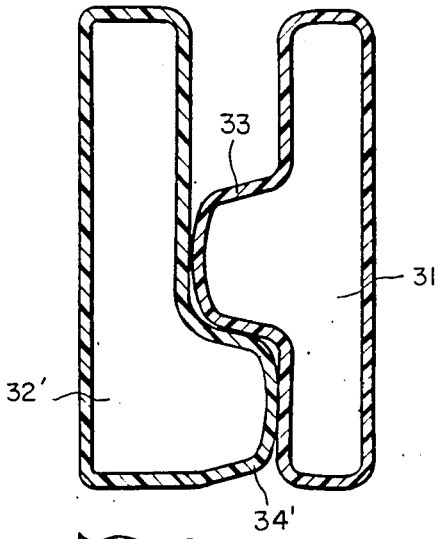
FIG. 10 is a sectional view of the closed hinge members taken along line 10–10 of FIG. 9*b*.
Figure 11:
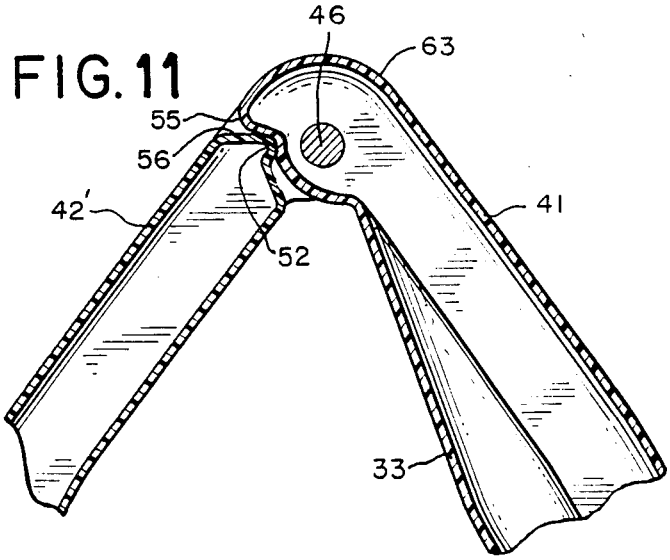
FIG. 11 is another sectional view of the novel hinge in an open position, taken along line 11—11 of FIG. 7.

As can be seen from FIGS. 3, 4 and 6, the hinge members 41 and 42 form an obtuse angle with the plane of the horizontal panel members 21, 22 and 23 and leg members 31 and 32. This "bent" configuration is part of the novel improvement over the prior art, and is important in the flat folding capability of the barricade. The hinge members are approximately 4.75 inches wide and 4.5 inches high. The reinforcing ribs 33 and 34 of the leg members 31 and 32 continue up the back of the hinge members 41 and 42, creating a bulge in the cross section of the hinge members 41 and 42 (FIG. 10) similar to the bulge in the cross section of leg members 31 and 32. The ribs 33 and 34 taper off as they reach the top of the hinge members 41 and 42.

Each panel unit 10 has three hinge projections, one centered at the top of hinge members 41 and two flush with the outside edges of hinge member 42. Hinge projection 63, atop hinge member 41, is about 1.75 inches wide. Hinge projections 66 and 62, atop hinge member 42, are about 1.5 inches wide. Between hinge projections 66 and 62 atop hinge member 42 is a mating surface 64 about 1.75 inches wide. Likewise on either side of hinge projection 63 are mating surfaces 61 and 65, each about 1.5 inches wide.

Each of the projections 62, 64 and 66 has a transverse hinge bolt hole 43 drilled through it. the hinge bolt hole is approximately 0.5 inches in diameter. Bolt 45 inserts into these bolt holes as shown in FIG. 8 to pivotly interconnect the hinge member 42 of panel unit 10 with the hinge member 41' of panel unit 10'. Likewise, bolt 46 connects the hinge member 41 of panel unit 10 with the hinge member 42' of panel unit 10' (FIG. 7). Bolts 45 and 46 are metal. Bolt 45 also connects a metal auxiliary mounting bracket 81 to the assembled barricade.

The auxiliary mounting bracket 81 is approximately 3.5 inches high. The bolt hole 82 on this fixture is slotted for height adjustment. The bracket is constructed from one stamped metal piece 85 of a keyhole shape and a cap insert 83 welded into the circular part of the keyhole shaped piece 85. The cap insert 83 has a hole 101 in its center. Various configurations of mounting angles and heights may be achieved from this bracket. Accessories are attached by inserting the accessory's conventional mounting pen through hole 101.

When panel unit 10 and 10' are placed back to back, the projections intermesh, projection 63 of panel unit 10 fitting between projections 66' and 62' and contacting mating surface 64' of panel unit 10'. Likewise, projections 66' and 62' of panel unit 10' contact, respectively mating surfaces 65 and 61 of panel unit 10. The projections and mating surfaces on the other hinge members line up in exactly the same manner.

Each mating surface includes a mating surface notch 51 and a mating surface protuberance 52. Each hinge projection includes an upper projection protuberance 55. In addition, projections 62 and 66 include a lower projection protuberance 53, and a projection notch 54 positioned between the protuberances 53 and 55. The shape of these notches and protuberances is such that when each of the six hinge projections and their corresponding mating surfaces of the two opposing panel units are held in place by bolts 45 and 46, the protuberances and notches cooperate to form a detent, which provides the novel locking feature of the present invention.

Figure 9:
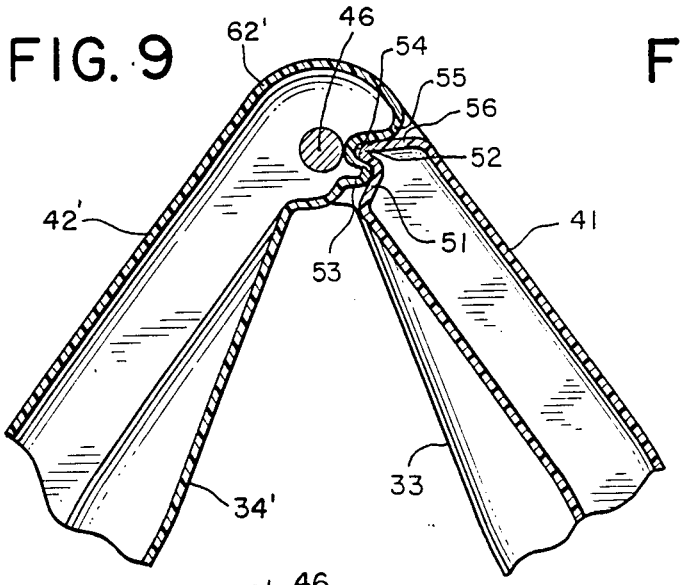
FIG. 9 is a sectional view of the novel hinge in an open position, taken along line 9—9 of FIG. 7.
Figure 9B:
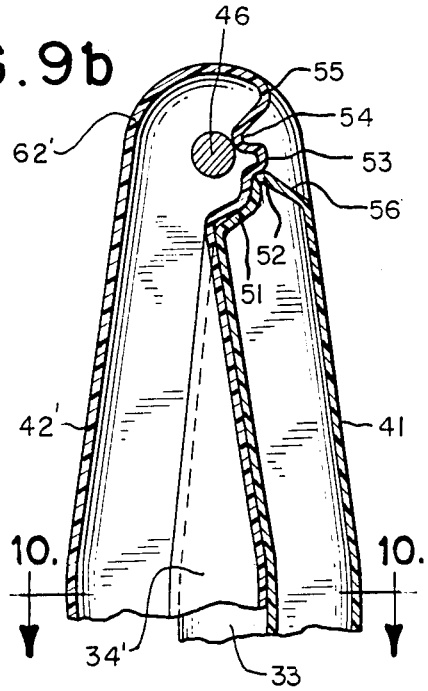
FIG. 9*b* is a sectional view of the novel hinge of FIG. 9 in a closed position.
Figure 9A:
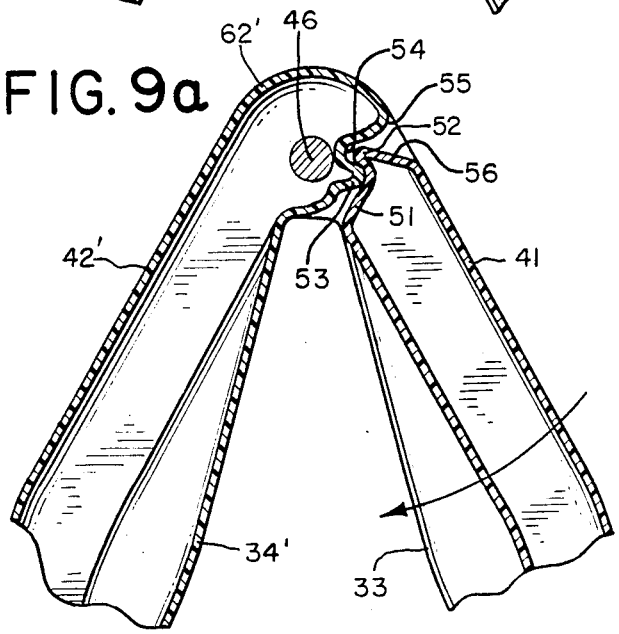
FIG. 9*a* is a sectional view of the novel hinge of FIG. 9 in an intermediate position.

The detent operates as follows. When panel units 10 and 10' are first spread apart from a closed, storage position (FIG. 9*b*), the mating surface protuberance 52, which has been under the hinge projection protuberance 53, slides around protuberance 53 and into the hinge projection notch 54. Meanwhile, the protuberance 53 slides into mating surface notch 51. The notches and protuberances are formed such that, because the panel units are hinged together, the plastic material must elastically deform in order for the protuberances 52 and 53 to move around each other. When the legs of the barricade are forced into their predetermined open position (FIG. 9), the resilient plastic snaps back into its normal alignment and the upper hinge projection protuberance 55 comes to rest against the top surface 56 of the opposing mating surface. The barricade legs are thus locked in the open position until a force of sufficient magnitude pushes the legs back together. Such a force causes the various portions of plastic hinge members to again deflect as the protuberances move in the reverse direction, out of the notches and back to their closed relationship. For the design of the preferred embodiment, the force required to close the barricade is greater than the force required to completely tip the open ballasted barricade over. Thus this force is greater than the force exerted by a wind of sufficient strength to rock the barricade back on one set of foot members 71 and 72.

Two features of the design of the preferred embodiment cooperate to allow the barricade to close flat. First, the reinforcing ribs 33 and 34 of leg members 31 and 32 are positioned such that when the panel units 10 and 10' and placed back to back, the ribs 33 and 34' of opposing leg members 31 and 32' do not interfere with each other, but fold side by side and against the narrow part of the opposing leg member (see FIG. 10). Second, the hinge members 41 and 42 are "bent" toward the back of the panel 10. Because of this, the hinge bolt 45 is in a plane behind the plane of the back face of the horizontal panel members 21, 22 and 23. In addition, the reinforcing ribs 33 and 34 taper off as they continue up the back of the hinge members 41 and 42 so as not to interfere with the back of the opposing hinge members 42' and 41'. Thus the hinge sections 41, 41', 42 and 42' are not under any significant stress when the barricade is in a folded, flat position.

As shown in FIG. 6, the top surface 27 of panel member 21 is not perpendicular to the face of the panel unit. Instead it is at an angle such that when the barricade is in an open position, the top surfaces 27 and 27' of panel members 21 and 21' are parallel with the plane containing the foot members 71, 72, 71' and 72'. The top surfaces 27 and 27' thus provide a place on which a flasher may squarely rest.

Panel unit 10 is made from about 6 pounds of high density polyethylene using conventional blow molding techniques. Bolts 45 and 46 may be plastic, but it has been found that metal bolts hold the hinge members together more rigidly and make the detent feature work better because the plastic material of hinge members 41 and 42, including the projection and mating surface protuberances 53 and 52, resiliently deform rather than the bolts. In a slightly modified embodiment, hinge projection 64, like projections 62 and 66, includes a lower projection protuberance 53 and projection notch 54. It has been found, however, that the detent feature described in the preferred embodiment worked better than the modified embodiment which included the protuberance 53 on hinge projection 64.

While the preferred embodiment of the invention has been disclosed, it is understood that the invention is not limited to such an embodiment. The scope of the invention is indicated by the appended claims rather than the foregoing description, and all changes which come within the meaning and range of equivalency of the claims are therefore intended to be embraced therein.

I claim:

1. An improved plastic barricade comprising two integrally molded, generally planar panel units hinged together by one or more bolts extending through one or more bolt holes formed in hinge members integrally molded on said panel units, each of said panel units including reinforcing ribs outstanding from the back of the plane of the panel units, wherein:

(a) (i) said hinge members extend from the panel units at an angle obtuse to the plane of the panel units,
(ii) said reinforcing ribs extend onto said hinge members, and
(iii) said reinforcing ribs are shaped and positioned relative to one another and said hinge members so that said panel units may collapse to a closed, storage relationship wherein the planes of the panel units are parallel opposing ones of said reinforcing ribs intermesh in a side-by-side relationship; and (b) said hinge members include detent means which oppose the collapse of the panel units from an open relationship to said closed relationship, said detent means comprising plastic notches and protuberances which cause portions of said hinge members to elastically deform as said panel units are spread to or collapsed from said open relationship.

2. The improved traffic barricade of claim 1 wherein: said panel units are substantially identical to each other.

3. The improved barricade of claim 1 wherein: a bracket useful for mounting barricade accessories is held in position by at least one of said bolts.

4. The improved barricade of claim 1 wherein: the detent means comprises one or more plastic protuberances molded into the plastic section of said hinge means of one said panel unit and one or more notches molded into the plastic section of said hinge means of the other said panel unit such that said one or more protuberances fit into said one or more notches when said panel units are in said operational relationship but when said panel units are in between said operational and said closed relationships said one or more protuberances and said one or more notches do not coincide but force said plastic sections of said hinge means to resiliently deflect.

5. The improved barricade of claim 1 wherein: said panel units are suitable for holding ballast.

6. An improved plastic barricade constructed from two substantially similar panel units hinged together to pivot around a common axis of rotation, wherein:

(a) each panel unit, having an outward facing front face, comprises:
(i) horizontal panel members,
(ii) vertical leg members with extended foot portions and reinforcing ribs, and
(iii) hinge members molded on said panel units at an obtuse angle to the plane formed by said front face and a bolt hole with a bolt therethrough for fastening the panel units together; and wherein:

(b) said hinge members comprise a plurality of an equal number of projections and mating surfaces;

(c) said projections of one panel unit form pairs with said mating surfaces of the other panel unit when said panel units are fastened together with said fastening means;

(d) said projections and mating surfaces comprise protuberances and notches;

(e) said notches and protuberances of said projection and mating surface pairs interfere with free relative rotation of the two panel units about the common axis of rotation such that when the panel units are moved between a closed storage relationship to an open operational relationship portions of said hinge members elastically deform;

(f) said protuberances and notches cooperate to act as a detent, requiring a force greater than the force resulting from weight of said first panel unit to move said panel units between said open operational relationship and said closed storage relationship, (g) said reinforcing ribs extend onto said hinge member and taper off; and (h) said front faces of said panel units are permitted to move into parallel planes when said panel units are moved into a closed, storage relationship by the corresponding relationship between (i) the obtuse angle of said molded hinge member and the taper of said reinforcing ribs, and (ii) the relative position of opposing ones of said reinforcing ribs.

7. The improved barricade of claim 6 wherein:

said panel units are constructed of blow molded high density polyethyene.

* * * * *

UNITED STATES PATENT AND TRADEMARK OFFICE

CERTIFICATE OF CORRECTION

PATENT NO. : 4,624,210

DATED : November 25, 1986

INVENTOR(S) : Geoffrey M. Glass

It is certified that error appears in the above-identified patent and that said Letters Patent is hereby corrected as shown below:

IN THE DESCRIPTION OF THE PREFERRED EMBODIMENT

In column 3, line 27, please delete "circuit" and substitute therefor --circular--;

In column 4, line 2, please delete "the" and substitute therefor --The--;

In column 5, line 9, please delete "side by side" and substitute therefor --side-by-side--.

IN THE CLAIMS

In Claim 1 (column 5, line 68), please insert --and-- before the word "opposing";

In Claim 6 (column 6, lines 63-64), please delete "relationship," and substitute therefor --relationship;";

UNITED STATES PATENT AND TRADEMARK OFFICE

CERTIFICATE OF CORRECTION

PATENT NO. : 4,624,210

DATED : November 25, 1986

INVENTOR(S) : Geoffrey M. Glass

It is certified that error appears in the above-identified patent and that said Letters Patent is hereby corrected as shown below:

In Claim 7 (column 8, line 5), please delete "polyethyene" and substitute therefor --polyethylene--.

Signed and Sealed this

Twelfth Day of April, 1988

*Attest:*

*Attesting Officer*

DONALD J. QUIGG

*Commissioner of Patents and Trademarks*